US008397459B2

(12) United States Patent
Gately

(10) Patent No.: US 8,397,459 B2
(45) Date of Patent: Mar. 19, 2013

(54) FIBERGLASS SIDING

(76) Inventor: Daniel A. Gately, Duluth, GA (US)

( * ) Notice: Subject to any disclaimer, the term of this patent is extended or adjusted under 35 U.S.C. 154(b) by 0 days.

(21) Appl. No.: 12/651,468

(22) Filed: Jan. 2, 2010

(65) Prior Publication Data

US 2010/0170182 A1 Jul. 8, 2010

Related U.S. Application Data

(60) Provisional application No. 61/204,132, filed on Jan. 2, 2009.

(51) Int. Cl.
*E04D 1/00* (2006.01)
*E04B 5/00* (2006.01)
*E04B 9/00* (2006.01)

(52) U.S. Cl. ..... 52/539; 52/409; 52/478; 52/536

(58) Field of Classification Search ..... 52/105, 52/536, 539, 409, 478, 518
See application file for complete search history.

(56) References Cited

U.S. PATENT DOCUMENTS

| | | | | | |
|---|---|---|---|---|---|
| 525,442 | A * | 9/1894 | Burrows | 52/539 |
| 3,968,610 | A * | 7/1976 | Medow | 52/314 |
| 4,226,070 | A * | 10/1980 | Aragon | 52/57 |
| 5,016,416 | A * | 5/1991 | Munk | 52/539 |
| 5,224,318 | A * | 7/1993 | Kemerer | 52/521 |
| 6,298,626 | B2 * | 10/2001 | Rudden | 52/520 |
| 6,625,939 | B1 * | 9/2003 | Beck et al. | 52/105 |
| 6,679,011 | B2 * | 1/2004 | Beck et al. | 52/105 |
| 6,715,240 | B2 * | 4/2004 | Beck et al. | 52/105 |
| 6,770,354 | B2 * | 8/2004 | Randall et al. | 428/219 |
| 7,222,465 | B2 * | 5/2007 | Watson et al. | 52/592.6 |
| 7,318,282 | B2 * | 1/2008 | Pulte | 29/897 |
| 7,520,099 | B2 * | 4/2009 | Pringle et al. | 52/408 |
| 7,748,183 | B2 * | 7/2010 | Myers et al. | 52/302.1 |
| 2001/0013211 | A1 * | 8/2001 | Rudden | 52/539 |
| 2002/0069600 | A1 * | 6/2002 | Bryant | 52/309.9 |
| 2002/0112416 | A1 * | 8/2002 | Beck et al. | 52/105 |

OTHER PUBLICATIONS

Tecton Products LLC, Tecton Products LLC Innovative Fiberglass Building Products (PDF brochure), Jan. 2009.
Mastic Home Exteriors, Mastic™ vinyl siding (PDF document).

* cited by examiner

*Primary Examiner* — Andrew Triggs
(74) *Attorney, Agent, or Firm* — Christopher Paul Mitchell

(57) ABSTRACT

A fiberglass siding piece may be formed. The fiberglass siding piece includes an upper seating portion of the fiberglass siding piece. The upper seating portion includes an angled siding seat. The fiberglass siding piece further includes a main portion of the fiberglass siding piece, and a lower seating portion of the fiberglass siding piece. The lower seating portion includes an angled siding seat. The angled siding seat of the upper seating portion is configured to receive the angled siding seat of the lower seating portion of an adjacent fiberglass siding piece. The upper seating portion may include slots configured to accept fasteners to fasten the fiberglass siding piece to a building.

18 Claims, 6 Drawing Sheets

FIBERGLASS SIDING

CROSS-REFERENCE TO RELATED APPLICATIONS

This application claims priority from provisional application Ser. No. 61/204,132, filed Jan. 2, 2009, the disclosure of which is hereby incorporated by reference in its entirety.

BACKGROUND

1. Field

Embodiments of the present invention relate generally to siding and, more particularly, to fiberglass siding.

2. Description of the Related Art

Siding is popular outer covering or cladding of a building, e.g., a house. Siding shields the building from inclement weather and plays a significant role in the appearance of the building.

Traditionally, siding was manufactured from wood. Although generally aesthetically pleasing, the maintenance wood siding requires is undesirable and it can be relatively heavy. Metal siding, e.g., aluminum siding, can be made to imitate the appearance of wood, and requires less maintenance than traditional wood siding. However, like wood, metal siding can be relatively heavy. In the case of, e.g., aluminum siding, metal siding can be susceptible to impact damage, e.g., such as that caused by hail storms. Vinyl siding offers the benefits of moderate durability, some resistance to impact damage, and low maintenance. However, some might argue that vinyl siding is not as aesthetically pleasing because it is considered "floating" on the building.

A more recent siding choice is fiber cement siding which is formed of light weight cement and wood fibers. Although aesthetically pleasing, this type of siding also has its drawbacks. For example, both of the main components (cement and wood fibers) absorb water. It is a heavy product that can get even heavier when saturated with water.

Each of these existing siding choices may be environmentally unfriendly. For example metal siding is energy intensive to manufacture. Further, each of these existing siding choices benefit from installation knowledge and multiple people when being installed. For example fiber cement, due to its weight, often requires multiple installers.

It would be desirable for siding to incorporate many of the advantages of existing siding choices, while excluding many of the disadvantages.

BRIEF SUMMARY

According to an aspect of the invention, a fiberglass siding piece is provided. The fiberglass siding piece includes an upper seating portion of the fiberglass siding piece. The upper seating portion includes an angled siding seat. The fiberglass siding piece further includes a main portion of the fiberglass siding piece, and a lower seating portion of the fiberglass siding piece. The lower seating portion includes an angled siding seat. The angled siding seat of the upper seating portion is configured to receive the angled siding seat of the lower seating portion of an adjacent fiberglass siding piece. Such a confirmation may, in one or more embodiments, create an air and water tight seal against inclement weather conditions.

The foregoing and other aspects will become apparent from the following detailed description when considered in conjunction with the accompanying drawing figures.

DETAILED DESCRIPTION

Figure 1:
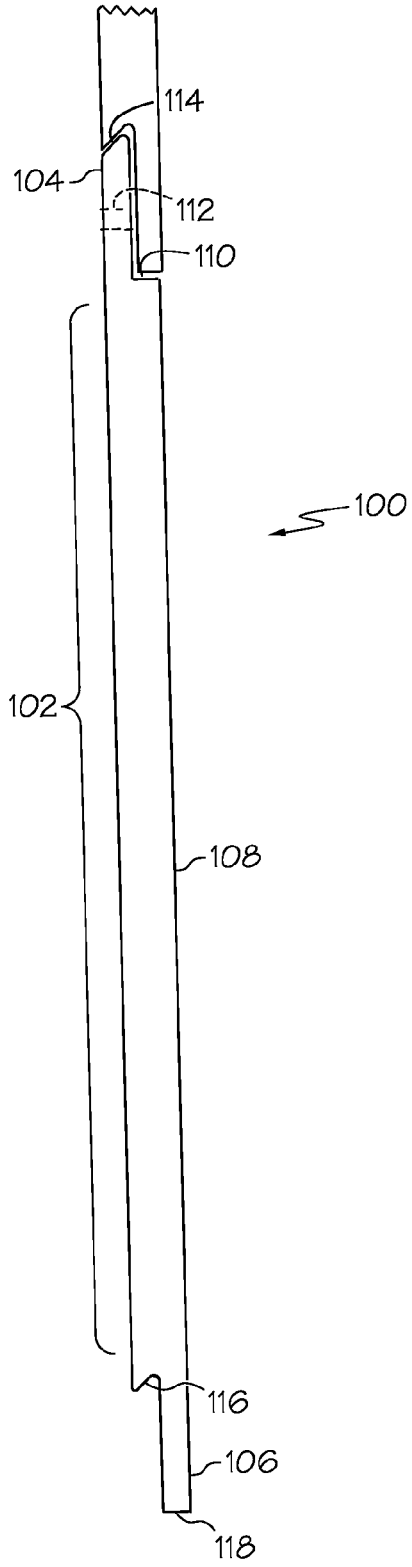
FIG. 1 is an end elevational view of a fiberglass siding piece according to an exemplary embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

As used in this application, the terms "a", "an" and "the" may refer to one or more than one of an item. The terms "and" and "or" may be used in the conjunctive or disjunctive sense and will generally be understood to be equivalent to "and/or". For brevity and clarity, a particular quantity of an item may be described or shown while the actual quantity of the item may differ. Features from an embodiment may be combined with features of another.

FIG. 1 is an end elevational view of a fiberglass siding piece 100 according to an exemplary embodiment of the present invention. The fiberglass siding piece may be formed of fiberglass or a fiberglass composite including a thermoset resin. The fiberglass siding piece 100 may be formed by a pultrusion manufacturing process. For example, in this exemplary embodiment, the fiberglass siding piece 100 is formed of seventy-five percent fiberglass roving and twenty-five percent polyester resin. It will be understood by one of ordinary skill in the art that the composition of the fiberglass siding piece 100 may be varied. For example, a greater or lower percentage of fiberglass and resin may be employed. In another embodiment, a fiberglass siding piece may be formed of fifty to ninety percent fiberglass and ten to fifty percent thermoset resin, e.g., polyester resin, vinylester resin or epoxy resin.

As noted above, the fiberglass siding piece 100 may be formed by a pultrusion manufacturing process. Because of the manufacturing process, and because of the properties of fiberglass or a fiberglass composite, the fiberglass siding piece 100 may be formed in a variety of lengths, e.g., a variety of predetermined lengths, or custom lengths. For example, in this exemplary embodiment, the fiberglass siding piece 100 may be formed in sixteen-foot lengths. In another exemplary embodiment, the fiberglass siding piece 100 may be formed in twenty-foot lengths. In another exemplary embodiment, the fiberglass siding piece 100 may be formed in a length matching the length of a face of a building to be sided. In such case, a seamless installation of fiberglass siding pieces 100 may be possible. The precise length of the fiberglass siding piece may be virtually unlimited, but for, e.g., transportation limitations.

Similarly, the fiberglass siding piece 100 may be formed including a variety of heights. For example, in this exemplary embodiment, the fiberglass siding piece 100 may include a seven-inch reveal and one-inch upper and lower seat portions 104, 106 (discussed below) yielding a nine-inch height. In another exemplary embodiment, the fiberglass siding piece 100 may include a five-over-five profile.

The fiberglass siding piece 100 may be formed in a variety of colors, textures, and shapes. For example, the face 108 of the fiberglass siding piece 100 may include a beaded edge. As another example, the fiberglass siding piece 100 may include shake or scalloped shapes. As another example, the face 108 of the fiberglass siding piece 100 may include a wood-texture. The fiberglass siding piece 100 may receive a coating during manufacture, or thereafter.

The fiberglass siding piece 100 may include a main portion 102, an upper seat portion (e.g., flange portion) 104, and a lower seat portion 106. The main portion 202 may include a face 108. The upper seat portion 104 may include an upper flat siding seat 110, slots 112, and an upper angled siding seat 114. The lower seat portion 106 may include a lower flat siding seat 118 and a lower angled siding seat 116.

The face 108 is on the front side of the fiberglass siding piece 100 and is the portion of the fiberglass siding piece 100 that is visible on a building after installation, e.g., the reveal. In this exemplary embodiment, the face 108 includes the front side of the main portion 102 and the front side of the lower seat portion 106. Opposite the face 108 is the back of the fiberglass siding piece 100. The back of the fiberglass siding piece 100 may abut the building when installed, thereby acting as a backing support to the fiberglass siding piece 100.

Upon installation, the upper seat portion 104 of a first fiberglass siding piece 100 and the lower seat portion 106 of an adjoining second fiberglass siding piece are mated together. As shown in FIG. 1, the upper angled siding seat 114 receives the lower angled siding seat 116 of the adjoining second fiberglass siding piece. The upper flat siding seat 110 receives the lower flat siding seat 118 of the adjoining second fiberglass siding piece.

Because of the inward (relative to a building) angle of the upper angled siding seat 114 of the first fiberglass siding piece 100, the adjoining second fiberglass siding piece may remain in place when the lower angled siding seat 116 of the adjoining second fiberglass siding piece is placed against or into the upper angled siding seat 114 of the first fiberglass siding piece. Accordingly, a single installer may position and nail, screw, or otherwise fasten the adjoining second fiberglass siding piece without the help of an additional installer. Further, due to the upper seat portion 104 and the lower seat portion 106, the installer may not need to measure the reveal, nor use a leveling device for subsequent fiberglass siding pieces after the starter strip or the first fiberglass siding piece is installed. Thus, installation is simple and more accurate. Further, an air and water tight seal may be achieved.

Because of the design of the fiberglass siding piece 100, installation may be simple in that less cuts and less movements of fiberglass siding pieces may be required during installation. This may significantly save on labor costs associated with installing fiberglass siding pieces compared with other types of siding currently available.

Because of the fiberglass based composition of the fiberglass siding panel, the fiberglass siding panel may be waterproof, lightweight, durable, and weather resistant. This may be beneficial when the fiberglass siding panel is stored, transported, and installed.

Because of the placement of the lower seat portion 106 of an adjacent second fiberglass siding piece overtop of the upper seat portion 104 of the first fiberglass siding piece 100, nails, screws, or other fasteners placed through the slots 112 of the first fiberglass siding piece 100 may be hidden. In other words, the fiberglass siding pieces may be blind nailed.

Because of the pultrusion manufacturing process, the fiberglass siding piece 100 may be lightweight and strong, which may be beneficial in terms of storage, transportation, and installation. Further, the fiberglass siding piece 100 may be considered a green product in that it requires less energy to produce than other siding types. Further, the fiberglass siding piece 100 may have less waste throughout installation and may be recyclable.

Figure 2:
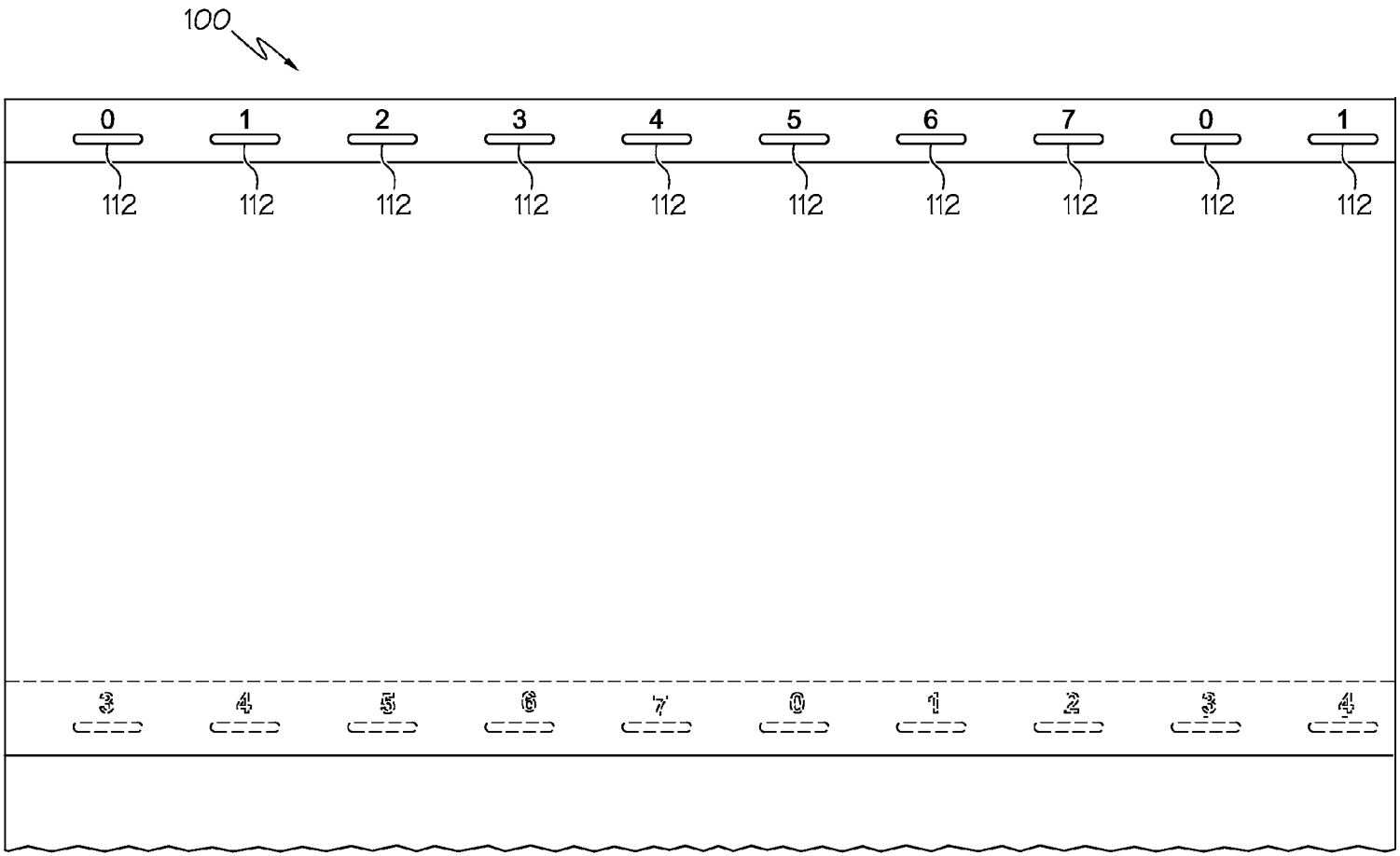
FIG. 2 is a front elevational view of the fiberglass siding piece of FIG. 1.

FIG. 2 is a front elevational view of the fiberglass siding piece 100 of FIG. 1. As noted above, the fiberglass siding piece 100 may include slots 112. In this exemplary embodiment, the slots 112 may each be one inch wide, ⅛th of an inch tall, and spaced one inch apart. It will be understood by one of ordinary skill in the art that the measurements associated with, among other items, the slots may be varied. As discussed below, one or more of the slots 112 may receive nails, screws, or other fasteners to attach the fiberglass siding piece 100 to a building.

The fiberglass siding piece 100 may include slot indicia, which may serve as a corresponding numbering system of slots for stud location as each fiberglass siding piece 100 is installed. For example, in this exemplary embodiment, the fiberglass siding piece 100 may include slot indicia including the numbers "0" through "7". Particular slot indicia may correspond to particular slots 112. The slot indicia "0" may correspond to the first slot 112, the slot indicia "1" may correspond to the second slot 114, and so on in like manner up through the slot indicia "7" which may correspond to the eighth slot 112. At that point, the indicia may repeat in order for the next eight slots 112. Accordingly, the indicia "0" may correspond to the ninth slot 112.

During installation, a stud may be identified into which a nail, screw, or other fastener may be placed to attach the fiberglass siding piece 100 to the building using a slot. If the slot indicia "0" corresponds with the particular slot 112 that lines up with the identified stud, then all slots corresponding with the slot indicia "0" may have a stud placed behind them. That is, the slots corresponding with the slot indicia "0" may be placed at a same distance from one another as the distance from one stud to another. For example, in this exemplary embodiment, the slot corresponding with the slot indicia "0" may be sixteen-inches on center from one another. Accordingly, an installer may, after identifying one stud of a building face, use the slots 112 having the slot indicia "0" to insert additional nails, screws, or other fasters to attach the fiberglass siding piece 100 to the building. It will be understood that by one of ordinary skill in the art that the numbering or labeling of the slot indicia as well as the spacing of the slots may be varied.

The slot indicia may be used in a second manner to identify slots 112 having studs behind them. When two fiberglass siding pieces 100 adjoin one other (e.g., as discussed above), the slot indicia of the first fiberglass siding piece may be corresponded with the slot indicia of the adjoining second fiberglass siding piece. For example, in the exemplary embodiment shown in FIG. 2, slot indicia "3" of the adjoining second fiberglass piece corresponds to slot indicia "0" of the first (e.g., previously installed) fiberglass siding piece. It should be noted that lower siding pieces may affixed before upper siding pieces. Returning to the exemplary embodiment shown in FIG. 2, all slots in the adjoining second fiberglass siding piece corresponding with the slot indicia "3" may have a stud behind them. This use of the slot indicia may be useful when a fiberglass siding piece 100 is being installed in a seamed manner, e.g., fiberglass siding pieces placed side by side and each fiberglass siding piece 100 not matching the length of a face of a building to be sided. It should be noted that when the fiberglass siding piece is being installed in a seamed manner, the seam may receive a fiberglass based adhesive strip on a back of the seam.

Figure 3:
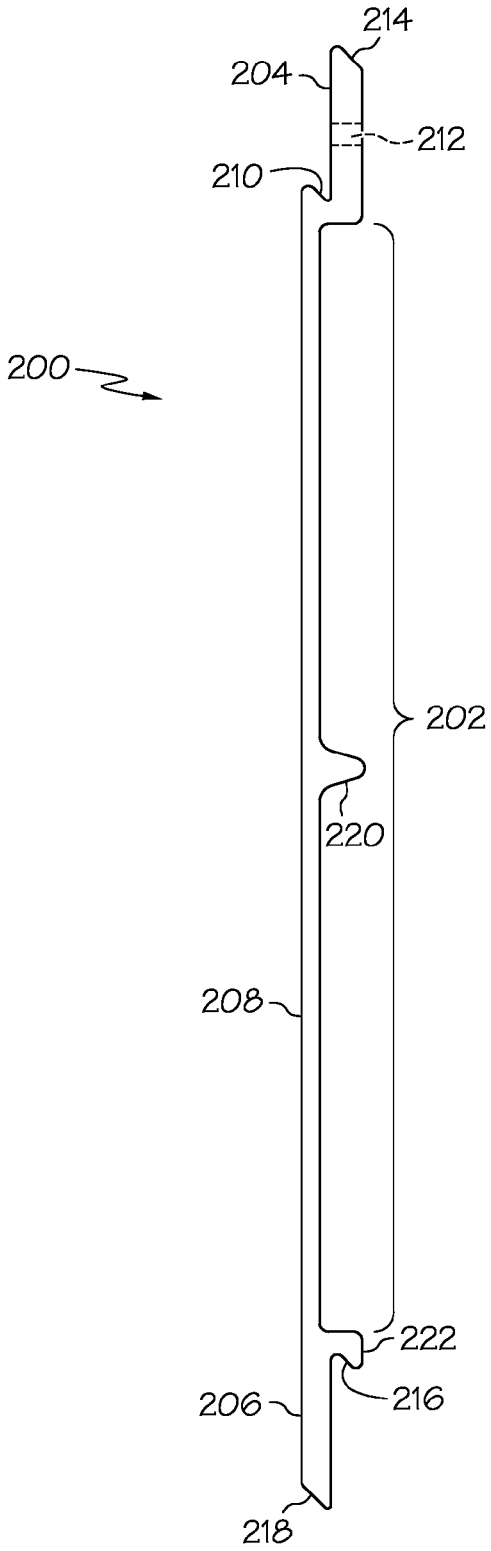
FIG. 3 is an end elevational view of a fiberglass siding piece according to another exemplary embodiment of the present invention.

FIG. 3 is an end elevational view of a fiberglass siding piece 200 according to another exemplary embodiment of the present invention. The fiberglass siding piece 200 may be formed of fiberglass or a fiberglass composite. Aspects of the fiberglass siding piece 200 may be formed similarly in terms of material and dimension to the fiberglass siding piece 100 of FIG. 1. Further, benefits may be similar to those of the fiberglass siding piece 100 of FIG. 1. Accordingly, a detailed discussion of such similar aspects is omitted here for the sake of brevity.

The fiberglass siding piece 200 may include a main portion 202, an upper seat portion 204, and a lower seat portion 206. The main portion 202 may include a thickness of one-tenth of one inch. The main portion 202 may include a face 208. The upper seat portion 204 may include a first upper angled siding seat 214, slots 212, and a second upper angled siding seat 210. The slots may be formed in a variety of sizes and shapes. For example, in this exemplary embodiment, the slots may be one-eighth inch nail slots. The upper seat portion 204 may include a thickness of 0.188 inches. The lower seat portion 206 may include a first lower angled siding seat 218 and a second lower angled siding seat 216. The second lower angled siding seat 216 may be formed of a protruding element 222 and may include a surface angled forty-five degrees relative to the back of the lower seat portion 206. The upper seat portion 204 and the main portion 202 may be may be non-coplanar. The lower seat portion 206 and the main portion 202 may be coplanar.

The face is on the front side of the fiberglass siding piece 200 and is the portion of the fiberglass siding piece 200 that is visible on a building after installation, e.g., the reveal. In this exemplary embodiment, the face 208 includes the front side of the main portion 202 and the front side of the lower seat portion 206. The face may include an seven-inch reveal and one-inch upper and lower seat portions 204, 206 yielding a nine-inch overall height. Opposite the face 208 is the back of the fiberglass siding piece 200. The back of the fiberglass siding piece 200 may include one or more protruding elements 220 that run the length of the piece. An outer point of the one or more protruding elements 220, the back of the upper seat portion 204, and an outer surface of the protruding element 222 may abut the building when installed, thereby acting as a backing support to the fiberglass siding piece 200.

Upon installation, the upper seat portion 204 of a first fiberglass siding piece 200 and the lower seat portion 206 of an adjoining second fiberglass siding piece are mated together. The first upper angled siding seat 214 receives the second lower angled siding seat 216 of the adjoining second fiberglass siding piece. The second upper angled siding seat 210 receives the first lower angled siding seat 218 of the adjoining second fiberglass siding piece.

Because of the inward (relative to a building) angle of both the first and second upper angled siding seats 214, 210 of the fiberglass siding piece 200, the adjoining second fiberglass siding piece may remain in place when both the first and second lower angled siding seats 218, 216 are placed against or into the first and second upper angled siding seats 214, 210.

Figure 4:
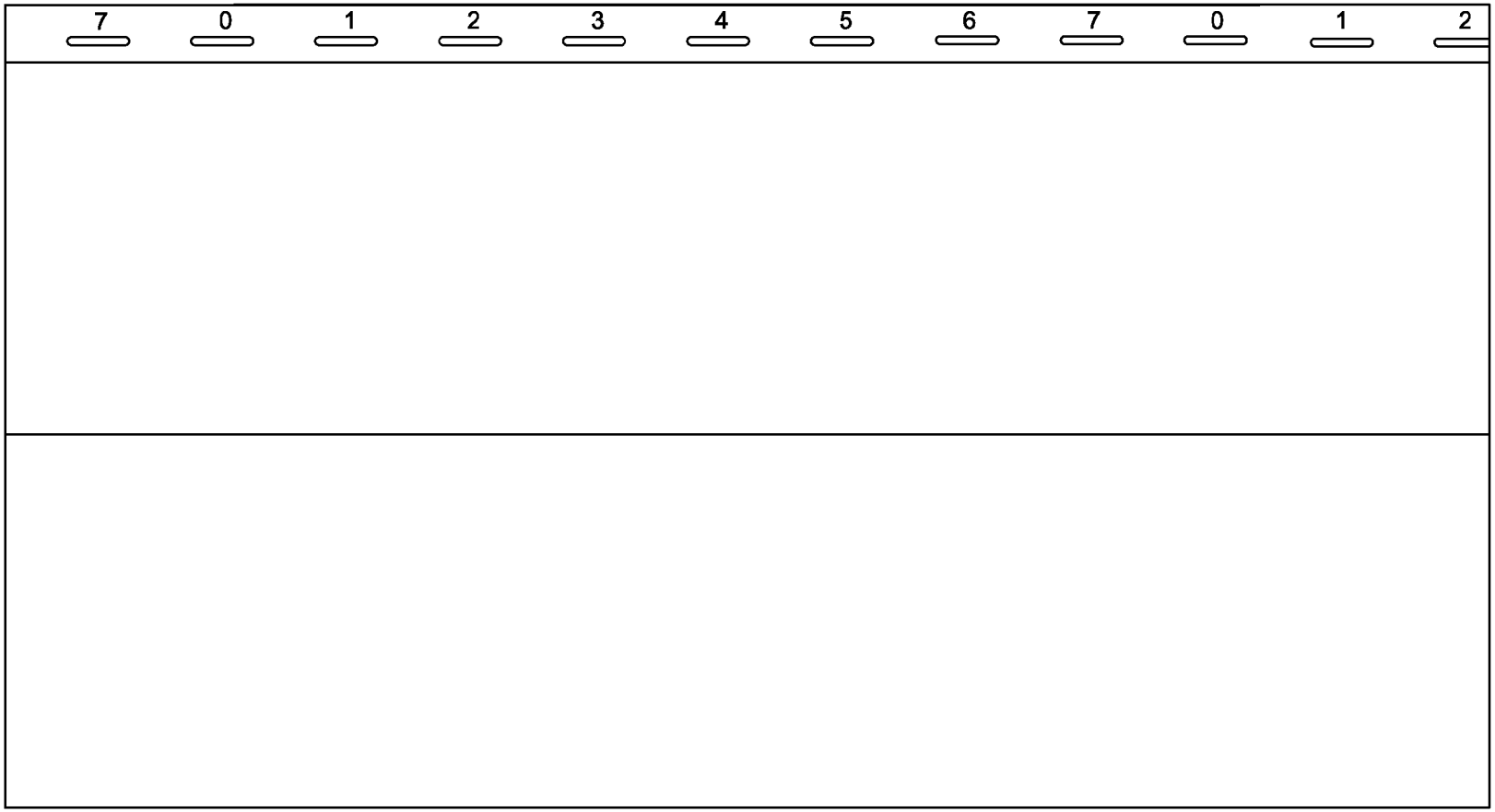
FIG. 4 is a front elevational view of two fiberglass siding pieces according to an exemplary embodiment of the present invention.
Figure 5:
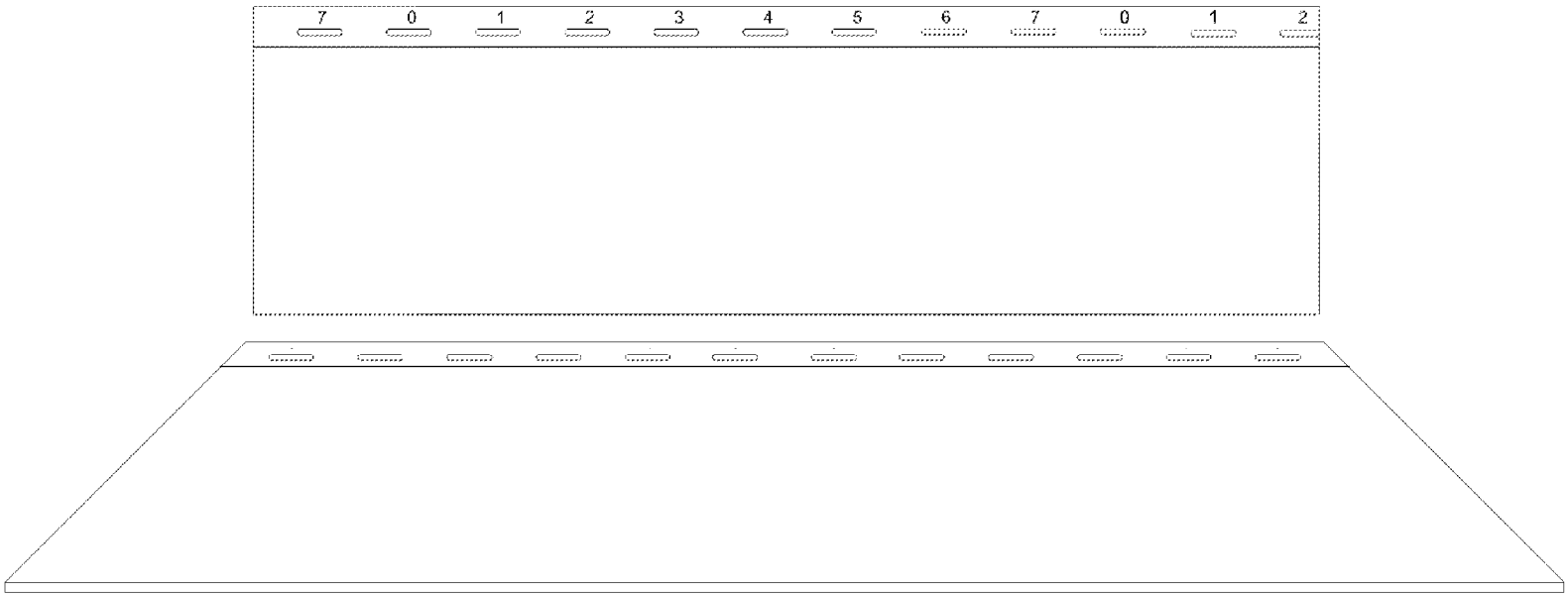
FIG. 5 is a front perspective view of the two fiberglass siding pieces of FIG. 4.
Figure 6:
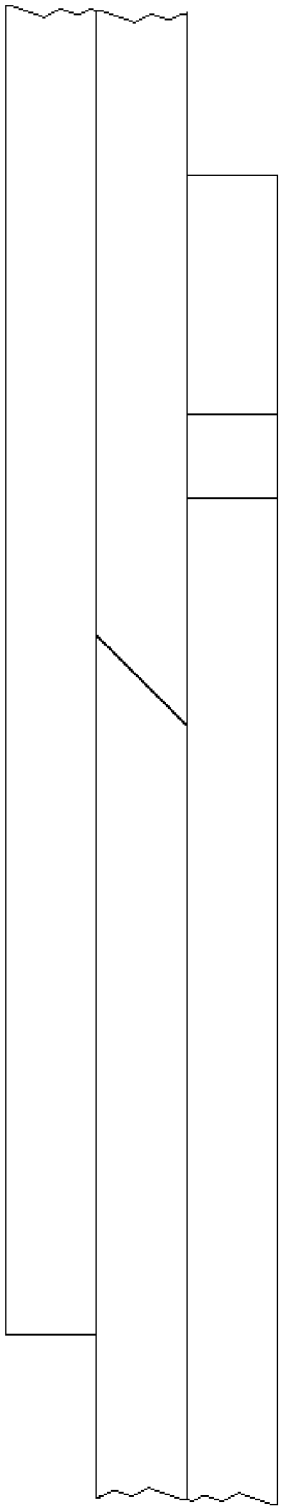
FIG. 6 is an end elevational view of the two fiberglass siding pieces of FIG. 4.

Numerous changes to the embodiments discussed above are contemplated. For example, the precise seating arrangement of a fiberglass siding piece may be varied as shown in FIGS. 4-6. Accordingly, although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A fiberglass siding piece, comprising:

an upper seating portion of the fiberglass siding piece, said upper seating portion including first and second angled siding seats;

a main portion of the fiberglass siding piece; and a lower seating portion of the fiberglass siding piece, said lower seating portion including first and second angled siding seats and a back, wherein the first and second angled siding seats of the upper seating portion are configured to receive the first and second angled siding seats of the lower seating portion of an adjacent fiberglass siding piece, wherein the first and second angled siding seats of the upper and lower seating portions are angled at a same angle relative to the main portion of the fiberglass siding piece, wherein the same angle is forty-five degrees relative to the back of lower seating portion, and wherein the first and second angled siding seats of the upper seating portion are connected by an upper vertical portion, wherein the first and second angled siding seats of the lower seating portion are connected by a lower vertical portion, wherein the upper vertical portion is configured to be positioned against the lower vertical portion of the adjacent fiberglass piece.

2. The fiberglass siding piece of claim 1, wherein the first and second angled siding seats of the of the upper seating portion and the first and second angled siding seats of the lower seating portion both slope downward from a front of the fiberglass siding piece.

3. The fiberglass siding piece of claim 1, wherein said upper seating portion includes slots configured to accept fasteners to fasten the fiberglass siding piece to a building.

4. The fiberglass siding piece of claim 3, wherein the fasteners comprise nails or screws.

5. The fiberglass siding piece of claim 3, further comprising slot indicia, said slot indicia configured to indicate stud location in the building.

6. The fiberglass siding piece of claim 1, further comprising a backing support to the fiberglass siding piece.

7. The fiberglass siding piece of claim 6, wherein the backing support to the fiberglass siding piece includes a protruding element midway along the back of the main portion of the fiberglass siding piece and running the length of the fiberglass siding piece.

8. The fiberglass siding piece of claim 1, wherein the fiberglass siding piece includes fiberglass rovings and a thermoset resin.

9. The fiberglass siding piece of claim 8, wherein the fiberglass siding piece includes fifty to ninety percent fiberglass and ten to fifty percent thermoset resin.

10. A fiberglass siding piece, comprising:

an upper seating portion of the fiberglass siding piece, said upper seating portion including first and second angled siding seats, and further including slots;

a main portion of the fiberglass siding piece; and a lower seating portion of the fiberglass siding piece, said lower seating portion including first and second angled siding seats and a back, wherein the first and second angled siding seats of the upper seating portion are configured to receive the first and second angled siding seats of the lower seating portion of an adjacent fiberglass siding piece, wherein said slots are configured to accept fasteners to fasten the fiberglass siding piece to a building, wherein the first and second angled siding seats of the upper and lower seating portions are angled at a same angle relative to the main portion of the fiberglass siding piece, wherein the same angle is forty-five degrees relative to the back of lower seating portion, and wherein the first and second angled siding seats of the upper seating portion are connected by an upper vertical portion, wherein the first and second angled siding seats of the lower seating portion are connected by a lower vertical portion, wherein the upper vertical portion is configured to be positioned against the lower vertical portion of the adjacent fiberglass piece.

11. The fiberglass siding piece of claim 10, wherein the first and second angled siding seats of both the upper and lower seating portions all slope downward from a front of the fiberglass siding piece.

12. The fiberglass siding piece of claim 10, wherein the fasteners comprise nails or screws.

13. The fiberglass siding piece of claim 10, further comprising slot indicia, said slot indicia configured to indicate stud location in the building.

14. The fiberglass siding piece of claim 10, further comprising a protruding element as a backing support midway along on a back of the main portion of the fiberglass siding piece and running the length of the fiberglass siding piece.

15. The fiberglass siding piece of claim 10, wherein the fiberglass siding piece includes fiberglass rovings and a thermoset resin.

16. The fiberglass siding piece of claim 15, wherein the fiberglass siding piece includes seventy-five percent fiberglass rovings and twenty-five percent polyester resin.

17. The fiberglass siding piece of claim 10, wherein the fiberglass siding piece is a pultrusion-formed fiberglass siding piece.

18. The fiberglass siding piece of claim 10, wherein the first and second angled siding seats fit together to create an air and water tight seal.

* * * * *